US005692639A

United States Patent [19]

Lahaussois et al.

[11] Patent Number: 5,692,639

[45] Date of Patent: Dec. 2, 1997

[54] DISPENSING HOLDER FOR PAPER TOWELS OR THE LIKE

[76] Inventors: Pierre Lahaussois, 25-13 Old Kings Hwy. North, Darien, Conn. 06820; Dale Strohl, 19 Taporneck Ct., Ridgefield, Conn. 06877

[21] Appl. No.: 756,551

[22] Filed: Nov. 26, 1996

[51] Int. Cl.[6] ..... A47K 10/24

[52] U.S. Cl. ..... 221/45; 221/283; 242/590

[58] Field of Search ..... 221/33, 45, 282, 221/283; 242/570, 590, 597.7, 597

[56] References Cited

U.S. PATENT DOCUMENTS 2,098,477 11/1937 Welsh ..... 221/45

*Primary Examiner*—Kenneth Noland
*Attorney, Agent, or Firm*—Schweitzer Cornman Gross & Bondell LLP

[57] ABSTRACT

A length of flexible cord is arranged to support a pair of stop elements below a hanging loop. The stop elements are of a size and shape to pass individually through the hollow cylindrical core of a roll of paper towels or toilet tissues but, when suspended in side-by-side relation at the bottom of a vertically oriented roll, are collectively too large to pass through the core and thus serve to support the roll in vertical orientation. A hanging loop at the top of the roll can be suspended over any convenient means, such as a hook, doorknob or the like, so that the holder is easily portable to a location in which the towels or tissues will be used. A section of the cord hangs downward over the exterior of the roll and serves to keep the roll from unwinding by gravity, and also provides a source of resistance against which individual sheets may be torn from the roll. This outer cord element may hang by gravity or may be engaged with the stop elements and thus held snugly against the exterior of the roll. The device is easily used, inexpensive to produce, and can be inserted entirely within the hollow cylindrical core of a roll of toweling or tissues, providing an advantageous marketing feature.

18 Claims, 2 Drawing Sheets

DISPENSING HOLDER FOR PAPER TOWELS OR THE LIKE

BACKGROUND AND SUMMARY OF THE INVENTION

The present invention is directed to a device for dispensing paper towels, toilet tissue and the like from a standard roll thereof, and more particularly to a novel, highly simplified and economical such dispensing device, which is easy to use, highly portable, and suitable for permanent or temporary installation at a convenient location.

In accordance with a preferred embodiment of the invention, a dispensing holder is constructed from a plurality of flexible elements carrying enlarged stop elements at their lower ends. The individual stop elements are of a size and shape to pass easily through the central cylindrical core of a roll of paper tissues, such as towels, toilet tissues or the like, but also of a size and shape such that, when two of the stop elements are positioned side by side, their collective width is too large to pass through the core. Preferably, the two stop elements are freely slidably supported on a continuous flexible support loop, which can be adjusted in length, such that the stop elements tend to assume a side-by-side relationship at the bottom of the loop. An adjusting collar, positioned at the upper end of the support loop, provides for the frictional retention of at least one element of the support loop, for adjusting its length. A hanging loop extends upwardly from the adjusting collar, enabling the dispensing holder to be hung at any convenient location, and on a nearby hook, on the knob of a cupboard or door, etc.

To particular advantage, an additional flexible element, suspended from the adjusting collar, hangs along the exterior surface of the paper roll and forms an edge against which individual sheets may be torn from the roll along the customary lines of weakness. In a particularly advantageous form of the invention, all of the elements thereof, including the support loop, the hanging loop and the tearing element, are formed of a single, continuous length of elongated flexible material, preferably of an elastic nature.

Because of the flexible nature of the device, and the economy with which it may be provided, it is ideally suited for distribution as a give-away premium device. For example, it can be suitably packed within the core of a roll of paper towels or toilet tissue for sale therewith. The ease of use and portability of the device makes it convenient to employ a number of them at convenient locations.

For a more complete understanding of the above and other features and advantages of the invention, reference should be made to the following detailed description of a preferred embodiment of the invention and to the accompanying drawings.

DESCRIPTION OF PREFERRED EMBODIMENT

Figure 1:
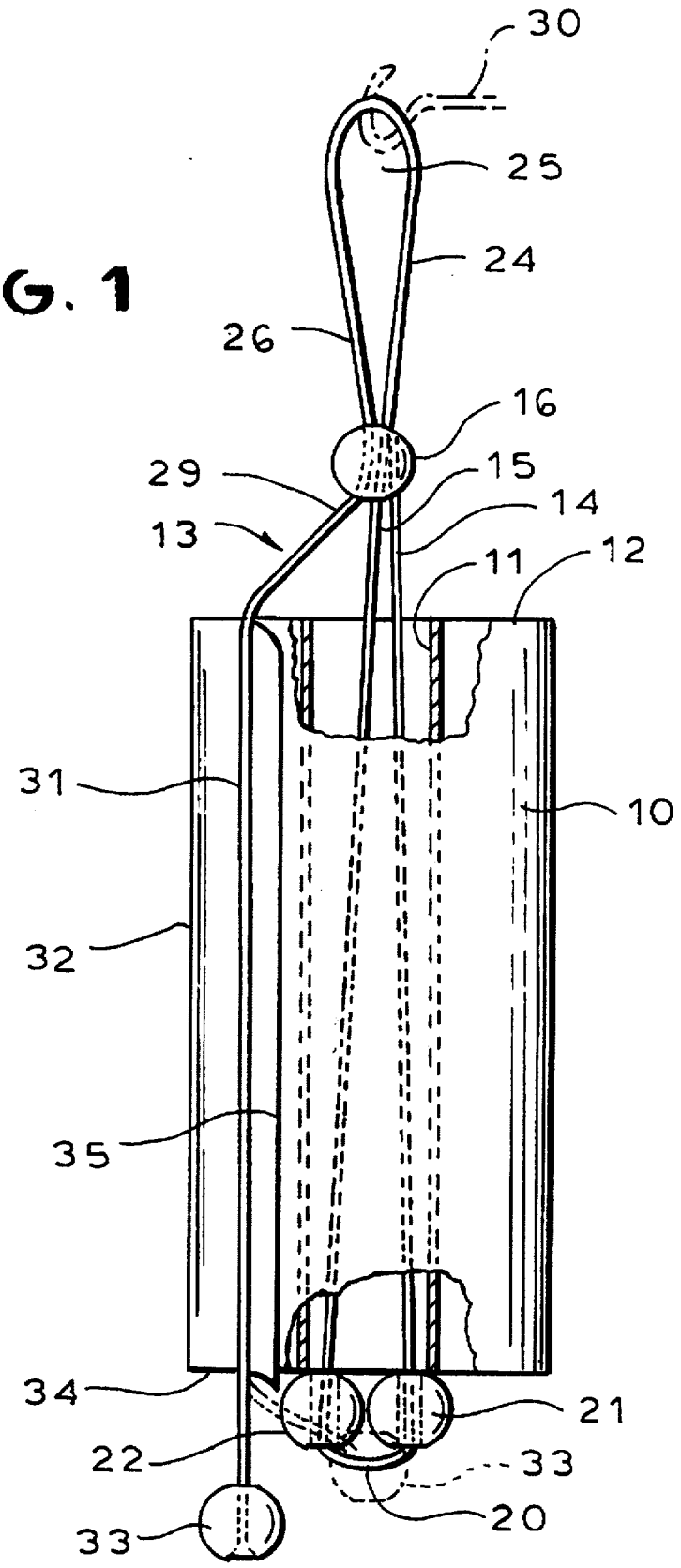
FIG. 1 is an elevational view, partly in section, showing a roll of paper towels supported by the dispensing holder device of the invention.

Referring now to the drawings, the referenced numeral 10 designates a typical, commercially available roll of paper towels. The roll 10 customarily includes a central hollow cylindrical core 11, formed of paperboard or similar material and having an inside diameter of approximately 1.5". The paper toweling 12 is wound continuously about the core 11 and conventionally is provided with repetitive, spaced-apart lines of weakness enabling individual sheets of toweling material to be separated from the roll.

In a particularly advantageous form, the dispensing holder of the invention is comprised of a single, continuous length of flexible cord 13. The cord 13 for a typical embodiment may be on the order of ⅛" in diameter and, if desired, may be somewhat elastic. However, materials such as commercially available braided nylon or cotton line are satisfactory and suitably inexpensive.

In the illustrated form of the invention, the cord 13 forms first and second lanyard sections 14, 15 extending downward from an adjusting collar 16. The upper end of the first lanyard section 14 is fixed to the adjusting collar 16, and preferably this is accomplished by passing the lanyard section through a bored passage 17 in the adjusting collar (see FIG. 3). A knotted end 18 of the lanyard section preferably is received in a recess 19 in the collar 16.

As shown in FIG. 1, the lanyard sections 14, 15 are joined at their lower ends 20, to form a support loop. The respective lanyard sections 14, 15 pass through and slidably retain respective stop elements 21, 22. The stop elements 21, 22 are provided with bored passages which are sufficiently larger in diameter than the size of the lanyard section 14, 15 as to enable the stop elements 21, 22 to freely slide on the lanyard elements. Accordingly, the stop elements will tend to move by gravity to the lowest possible position, placing the stop elements in a generally side-by-side relation at the bottom of the support loop 20.

Pursuant to one aspect of the invention, the size and shape of the stop elements 21, 22 are such that the individual elements can pass freely through the hollow center of the roll core of the cylindrical roll core 11. In a particularly preferred embodiment of the invention, the stop elements are of spherical configuration, with a diameter of about 1.25". Accordingly, the two stop elements can be aligned one above the other and dropped by gravity through the vertically-oriented core 11. When the stop elements emerge from the lower end of the roll core, they will tend to slide by gravity to side-by-side orientation, as shown in FIG. 1. In such an orientation, the combined width of the two stop elements 21, 22 exceeds that of the roll core 11, so that the roll 10 can be supported in vertical orientation by the suspended stop elements.

Figure 3:
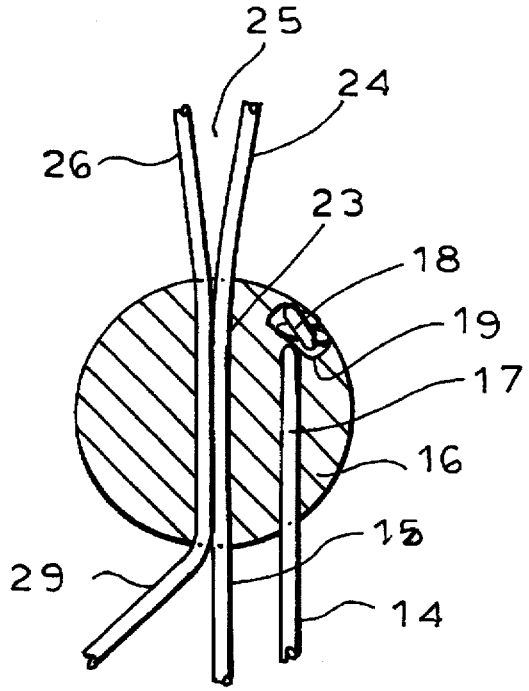
FIG. 3 is an enlarged cross-sectional view showing details of an adjusting collar device incorporated in the device of the invention.

As shown in FIGS. 1 and 3, the upper end of the lanyard section 15 passes through a bored passage 23 in the adjusting collar and continues upwardly forming a first section 24 of a hanging loop 25. An opposite section 26 of the hanging loop extends downward and passes through the same bored passage 23 of the adjusting collar. Where the two cord sections 27, 28 pass through the common passage 23, the respective diameters of the passage and the cord sections is such that the cord sections are frictionally gripped by the side walls of the passage 23. With this arrangement, the length of the support loop 20 can be adjusted by pulling upward on the loop section 24 or downward on the lanyard section 15. Likewise, the hanging loop 25 may be adjusted independently of the support loop by pulling upward on the hanging loop section 26 or downward on an extension 29 thereof emerging below the adjusting collar.

The hanging loop 25 provides a handy means for hanging the dispensing holder in a convenient location, either on a permanent basis or temporarily. In the latter case, a dispensing holder may be carried to a temporary project site, for example, where the toweling may be needed on a short-term basis. The hanging loop 25 may be hung over anything available, such as a hook 30, shown in FIG. 1, a doorknob, or any conveniently available appendage.

Figure 2:
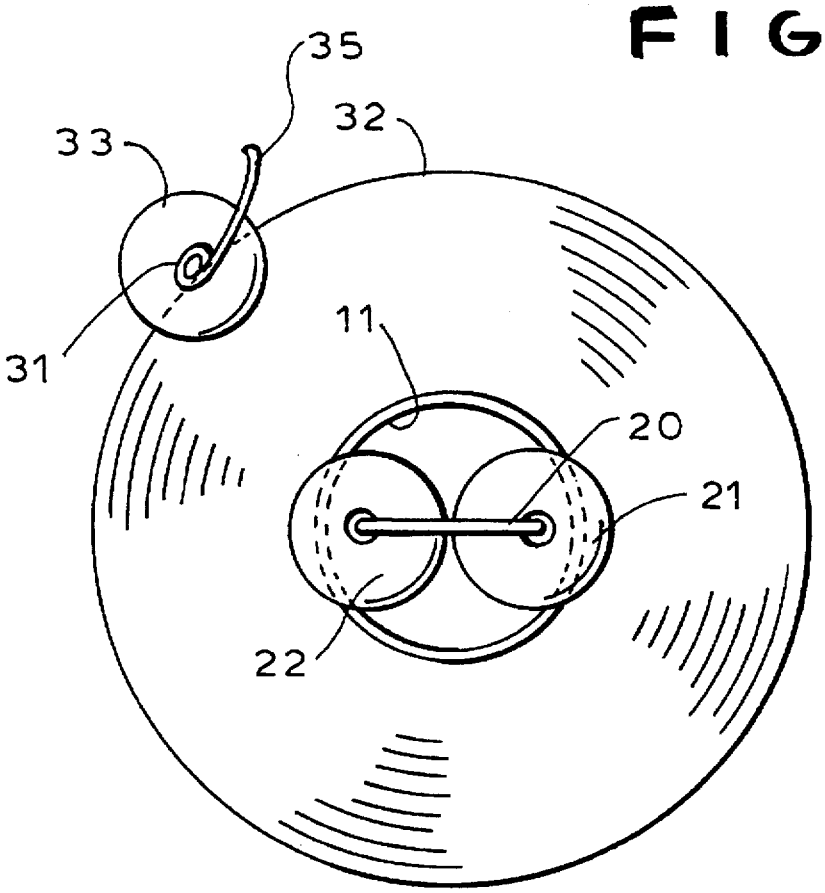
FIG. 2 is a bottom plan view of the device of FIG. 1.

In accordance with one aspect of the invention, a third lanyard section 31, extends from the cord section 29 and hangs vertically downward over the exterior side wall 32 of the paper roll, as shown in FIGS. 1 and 2. At its lower end, the lanyard section 31 supports a weight element 33. The length of the lanyard section 31 is such that the weight element 33 is positioned below the bottom edge 34 of the paper roll, as indicated in FIG. 1.

In a typical case, when a roll 10 of paper toweling is hanging vertically, as indicated in FIG. 1 of the drawings, the third lanyard section 31 contacts the outer surface of the roll, and an end portion 35 of the outermost toweling section will tend by gravity to hang out from the toweling roll. The roll is prevented from unravelling under gravity, however, by the presence of the lanyard section 31. At the same time, however, removal of an individual toweling section is facilitated, partly because an outer end portion of the section extends away from the roll, and partly because as the toweling section is pulled away from the roll the lanyard section 31 provides an element of resistance and causes the sheet to be easily torn away when the next line of weakness (typically a line of perforations) reaches the vicinity of the lanyard section 31.

In the arrangement shown in FIG. 1, the lanyard section 31 hangs freely downward under a relatively minimum weight provided by the weight element 33. In this respect, the weight element 33 may be a spherical element of the same size as the stop elements 21, 22 and also the adjusting collar 16. If a more positive confinement of the toweling and a more positive tearing edge is desired, the weight element 13 can be inserted between the stop elements 21, 22 and the bottom of the roll, to hang through the bottom most portion of the support loop 20, as indicated in broken lines in FIG. 1. In the latter configuration, the third, or exterior lanyard section 31, is held snugly against the outer surface of the roll of toweling.

In the preferred device of the invention, the length of the support loop 20 may be easily adjusted by drawing the line sections 15 or 24 in the appropriate direction through the bored passage 23 and the adjusting collar 16. The length of the hanging loop 25 and/or the length of the exterior lanyard section 31 may be adjusted by pulling on the respective line sections 26 or 29. The device will remain in any adjusted configuration by reason of the snug frictional fit of the cord sections within the bored passage 23 of the adjusting collar. Where the cord is formed of an elastic material, the elements thereof within the passage 23 may tend to elongate and narrow when placed under tension, facilitating adjustment, and thereafter expanding to reliably remain in any adjusted configuration. When the cord is formed of a relatively inelastic material, such as braided nylon or braided cotton cord, for example, the device may nevertheless be easily adjusted, inasmuch as the friction forces required for the apparatus to retain any adjusted configuration are relatively small.

The device of the invention is uniquely adapted to be marketed as a premium or giveaway item, along with the sale of paper toweling, toilet tissue or the like. In this respect, the entire dispensing holder may be easily contained within the hollow cylindrical core of a conventional roll of towels or tissues.

The device of the invention is particularly useful for elderly and disabled individuals because it is easily installed in an operative relation to a roll of tissues, such as paper towels, toilet tissue or the like is easily handled and carried, and easily placed on a doorknob or hook, for example in a location convenient to the user, even for temporary activities.

The nature of the device is such that it can be easily used by visually impaired or blind persons, for example. For such uses, it may be beneficial to employ tactile coding, such as grooves, ribs or the like, on the spherical elements. The device is easily reloaded with a new roll, when necessary. The reloading operation also can be performed with one hand, if necessary.

The device of the invention may be assembled from basic, economical materials. In this respect, the several spherical elements making up the stop elements, the weight element and the adjusting collar can be formed of inexpensive plastic material, but are more desirably formed of a material such as pressed wood, which is a normal by-product of the towel manufacturing process.

The extremely low cost and ease of use of the new dispensing holder device make it ideally suited for usage in greater numbers than conventional dispensers, which in general require fixed installation and may be aesthetically unattractive in settings outside of kitchens, bathrooms, workrooms and the like. The device of the present invention, on the other hand, may be temporarily installed in virtually any location for temporary projects, for example, since it may be as easily removed as installed. The device of the invention can be conveniently installed and utilized in recreational vehicles and taxi cabs, for example, and can also be conveniently used in such diverse places as gas stations and repair shops, for example, to keep tissues handy to the place as needed. For the disabled person, a device according to the invention can be easily and conveniently hung on a wheelchair. For the busy mother, the device can be suspended from a high chair or stroller, for example. Numerous other convenient usage locations and opportunities will readily come to mind.

It should be understood, of course, that the specific form of the invention herein illustrated and described is intended to be representative only, as certain changes may be made therein without departing from the clear teachings of the disclosure. Accordingly, reference should be made to the following claims in determining the full scope of the invention.

I claim:

1. A dispensing holder for a roll of tissues or the like, where the roll includes a hollow cylindrical core of predetermined diameter and having a central axis, and a wound roll of paper tissues or the like surrounding said core, said tissues being joined along lines of weakness for separation and individual use, said holder comprising (a) an adjusting collar, (b) first and second flexible lanyard sections extending downward from said adjusting collar, (c) first and second stop elements supported at lower end regions of said first and second lanyard sections, respectively, (d) said stop elements being of a size and shape to pass freely through said hollow cylindrical core and of a size and shape when suspended in side-by-side relation by said lanyard sections to be blocked from passage through said core, and (e) a hanger element extending upward from said adjusting collar for suspending said holder, to support a roll of paper towel tissues or the like with the axis thereof in a generally vertical orientation.

2. A dispensing holder according to claim 1, wherein (a) said first and second flexible lanyard sections comprise portions of a continuous support loop, (b) said stop elements are freely slidable on said support loop, whereby the action of gravity tends to slide said stop elements to a bottom portion of said support loop, with said stop elements generally in side by side relation.

3. A dispensing holder according to claim 2, wherein (a) one of said lanyard sections is fixed to said adjusting collar, (b) the other of said lanyard sections is slidable in said adjusting collar while being frictionally restrained therein, enabling the length of said support loop to be adjusted in accordance with the axial length of said core.

4. A dispensing holder according to claim 2, wherein (a) an extension of said other of said lanyard sections includes a first portion extending upward from said adjusting collar and a second portion extending downward to said collar to form a hanging loop for the suspension of said holder.

5. A dispensing holder according to claim 4, wherein (a) the downwardly extending portion of said hanging loop passes through said adjusting collar in frictionally restrained engagement therewith to enable adjustment of the length of said hanging loop independently of said downwardly extending continuous support loop.

6. A dispensing holder according to claim 5, wherein (a) the downwardly extending portion of said hanging loop and the upwardly extending portion of said continuous support loop passing through a common opening in said adjusting collar in frictionally restrained engagement therein.

7. A dispensing holder according to claim 1, wherein (a) a third flexible lanyard section extends downward from said adjusting collar, (b) a weighted element is attached to the end of said third lanyard section, (c) said third lanyard section being disposed along the exterior of said roll to serve as a tearing edge for removal of individual tissues.

8. A dispensing holder according to claim 7, wherein (a) said weighted element is inserted between a lower end extremity of said roll and the bottom portion of said support loop to secure said third lanyard section snugly against the exterior of said roll.

9. A dispensing holder according to claim 5, wherein (a) a third flexible lanyard section extends downward from said adjusting collar, (b) a weighted element is attached to the end of said third lanyard section, (c) said third lanyard section being disposed along the exterior of said roll to serve as a tearing edge for removal of individual tissues.

10. A dispensing holder according to claim 9, wherein (a) said third lanyard section is an extension of the downwardly extending portion of said hanging loop.

11. A dispensing holder according to claim 9, wherein (a) the downwardly extending portion of said hanging loop and the upwardly extending portion of said continuous support loop pass through a common opening in said adjusting collar in frictionally restrained engagement therein.

12. A dispensing holder according to claim 11, wherein (a) said first, second and third lanyard sections and said hanging loop comprising integral portions of a single, continuous, elongated flexible element.

13. A dispensing holder according to claim 12, wherein (a) said flexible element is formed of elastic material.

14. A dispensing holder for a roll of tissues or the like, where the roll includes a hollow cylindrical core of predetermined diameter and having a central axis, and a wound roll of tissues or the like surrounding said core, said tissues being joined along lines of weakness for separation and individual use, said holder comprising (a) an adjusting collar, (b) at least one flexible lanyard section extending downward from said adjusting collar, (c) at least one stop element supported at a lower end regions of said at least one lanyard section, (d) said stop element being of a size and shape to pass freely through said hollow cylindrical core and of a size and shape when suspended by said at least one lanyard section to be blocked from passage through said core, and (e) a hanger element extending upward from said adjusting collar for suspending said holder, to support a roll of tissues or the like with the axis thereof in a generally vertical orientation.

15. A dispensing holder according to claim 14, wherein (a) a plurality of stop elements are suspended from a plurality of flexible lanyard sections, (b) said plurality of stop elements, when suspended in side-by-side relation having a collective width greater than the diameter of said cylindrical core.

16. A dispensing holder according to claim 15, wherein (a) said hanger element comprises an upward extension of one of said lanyard sections, extending upward from said adjusting collar and forming a hanging loop.

17. A dispensing holder according to claim 14, wherein (a) an additional lanyard section extends downward along the exterior of said roll of tissues to form a tearing edge.

18. A dispensing holder according to claim 17, wherein (a) a weight element is attached to a lower end portion of said additional lanyard section.

* * * * *